US005133931A

United States Patent [19]

Cho

[11] Patent Number: 5,133,931

[45] Date of Patent: Jul. 28, 1992

[54] LITHIUM ALUMINUM ALLOY SYSTEM

[75] Inventor: Alex Cho, Richmond, Va.

[73] Assignee: Reynolds Metals Company, Richmond, Va.

[21] Appl. No.: 573,410

[22] Filed: Aug. 28, 1990

[51] Int. Cl.[5] ..... C22C 21/06

[52] U.S. Cl. ..... 420/541; 148/415; 148/440; 148/552; 148/693; 420/542; 420/543

[58] Field of Search ..... 420/541, 542, 543; 148/2, 11.5 A, 12.7 A, 159, 415, 440

[56] References Cited

U.S. PATENT DOCUMENTS

| | | | |
|---|---|---|---|
| 2,293,864 | 8/1940 | Stroup | 420/533 |
| 3,081,534 | 3/1963 | Bredzs | 420/537 |
| 3,306,717 | 2/1967 | Lindstrand et al. | 420/544 |
| 3,346,370 | 10/1967 | Jagaciak | 420/535 |
| 3,765,877 | 10/1973 | Sperry et al. | 420/535 |
| 3,773,502 | 11/1973 | Horvath et al. | 420/531 |
| 3,876,474 | 4/1975 | Watts et al. | 148/32 |
| 3,984,260 | 10/1976 | Watts et al. | 148/32 |
| 4,094,705 | 6/1978 | Sperry et al. | 148/2 |
| 4,297,976 | 11/1981 | Bruni et al. | 123/193 |
| 4,409,038 | 10/1983 | Weber | 148/12.7 A |
| 4,434,014 | 2/1984 | Smith | 148/3 |
| 4,526,630 | 7/1985 | Field | 148/159 |
| 4,532,106 | 7/1985 | Pickens | 420/528 |
| 4,571,272 | 2/1986 | Grimes | 148/11.5 A |
| 4,582,544 | 4/1986 | Grimes et al. | 148/11.5 A |
| 4,584,173 | 4/1986 | Gray et al. | 420/533 |
| 4,588,553 | 5/1986 | Evans et al. | 420/533 |
| 4,594,222 | 6/1986 | Heck et al. | 420/529 |
| 4,603,029 | 4/1986 | Quist et al. | 420/535 |
| 4,624,717 | 11/1986 | Miller | 148/12.7 A |
| 4,626,409 | 12/1986 | Miller | 420/533 |
| 4,635,842 | 1/1987 | Mohondro | 228/175 |
| 4,636,357 | 1/1987 | Peel et al. | 420/532 |
| 4,648,913 | 3/1987 | Hunt, Jr. et al. | 148/12.7 A |
| 4,652,314 | 3/1987 | Meyer | 148/2 |
| 4,661,172 | 4/1987 | Skinner et al. | 148/12.7 A |
| 4,681,736 | 7/1987 | Kersker et al. | 420/535 |
| 4,690,840 | 9/1987 | Gauthier et al. | 427/436 |
| 4,735,774 | 4/1988 | Narayanan et al. | 420/533 |
| 4,752,343 | 6/1988 | Dubost et al. | 148/12.7 A |
| 4,758,286 | 8/1988 | Dubost et al. | 148/12.7 A |
| 4,790,884 | 12/1988 | Young et al. | 148/2 |
| 4,795,502 | 1/1989 | Cho | 148/2 |
| 4,806,174 | 2/1989 | Cho et al. | 148/12.7 A |
| 4,816,087 | 3/1989 | Cho | 148/2 |
| 4,832,910 | 5/1989 | Rioja et al. | 420/528 |
| 4,840,682 | 6/1989 | Curtis et al. | 148/12.7 A |
| 4,844,750 | 7/1989 | Cho et al. | 148/12.7 A |
| 4,861,391 | 8/1989 | Rioja et al. | 148/12.7 A |
| 4,869,870 | 9/1989 | Rioja et al. | 420/532 |
| 4,889,569 | 12/1989 | Graham et al. | 140/130 |
| 4,897,126 | 1/1990 | Bretz et al. | 148/12.7 A |
| 4,915,747 | 4/1990 | Cho | 148/12.7 A |
| 4,921,548 | 5/1990 | Cho | 148/12.7 A |
| 4,923,532 | 5/1990 | Zedalis et al. | 148/159 |

FOREIGN PATENT DOCUMENTS

| | | | |
|---|---|---|---|
| 0158571 | 10/1985 | European Pat. Off. . | |
| 0227563 | 7/1987 | European Pat. Off. . | |
| 3346882 | 6/1984 | Fed. Rep. of Germany . | |
| 2561261 | 9/1985 | France . | |
| WO90/02211 | 7/1989 | PCT Int'l Appl. . | |
| 0057049 | 3/1969 | Poland | 420/541 |
| 1172736 | 2/1967 | United Kingdom . | |
| 2121822 | 1/1984 | United Kingdom . | |
| 2134925 | 8/1984 | United Kingdom . | |

OTHER PUBLICATIONS

Aluminum Association, "Aluminum Standards and Data 1988", cover page, pp. 15, 16.

Leter dated Oct. 17, 1990 from Aluminum Association Incorporated to Signatories of the Declaration of Accord.

"Registration Record of Aluminum Association Alloy Designations and Chemical Composition Limits for Aluminum Alloys in the Form of Castings and Ingot", Aluminum Association, Inc., revised Jan. 1989.

*Primary Examiner*—R. Dean
*Assistant Examiner*—Robert R. Koehler
*Attorney, Agent, or Firm*—Alan M. Biddison

[57] ABSTRACT

An aluminum based alloy useful in aircraft and airframe structures which has low density and consists essentially of the following formula:

$$Mg_aLi_bZn_cAg_dAl_{bal}$$

wherein a ranges from 0.5 to 10%, b ranges from 0.5 to 3.0%, c ranges from 0.1 to 5.0%, d ranges from 0.1 to 2.0%, and bal indicates the balance of the alloy is aluminum, with the proviso that the total amount of alloying elements cannot exceed 12.0%, with the further proviso that when a ranges from 7.0 to 10.0%, b cannot exceed 2.5% and c cannot exceed 2.0%.

12 Claims, No Drawings

LITHIUM ALUMINUM ALLOY SYSTEM

FIELD OF THE INVENTION

This invention relates to an improved aluminum Lithium alloy system and more particularly relates to a lithium aluminum alloy which contains magnesium and zinc and is characterized as a low density alloy with improved tensile strength suitable for aircraft and aerospace applications.

BACKGROUND

In the aircraft industry, it has been generally recognized that one of the most effective ways to reduce the weight of an aircraft is to reduce the density of aluminum alloys used in the aircraft construction. For purposes of reducing the alloy density, lithium additions have been made. However, the addition of lithium to aluminum alloys is not without problems. For example, the addition of lithium to aluminum alloys often results in a decrease in ductility and fracture toughness. Where the use is in aircraft parts, it is imperative that the lithium containing alloy have both improved ductility and fracture toughness and strength properties.

With respect to conventional alloys, both high strength and high fracture toughness appear to be quite difficult to obtain when viewed in light of conventional alloys such as AA (Aluminum Association) 2024-T3X and 7050-TX normally used in aircraft applications. For example, a paper by J. T. Staley entitled "Microstructure and Toughness of High-Strength Aluminum Alloys," Properties Related to Fracture Toughness, ASTM STP605, American Society for Testing and Materials, 1976, pp. 71-103, shows generally that for AA2024 sheet, toughness decreases as strength increases. Also, in the same paper, it will be observed that the same is true of AA7050 plate. More desirable alloys would permit increased strength with only minimal or no decrease in toughness or would permit processing steps wherein the toughness was controlled as the strength was increased in order to provide a more desirable combination of strength and toughness. Additionally, in more desirable alloys, the combination of strength and toughness would be attainable in an aluminum-lithium alloy having density reductions in the order of 5 to 15%. Such alloys find widespread use in the aerospace industry where low weight and high strength and toughness translate to high fuel savings. Thus, it will be appreciated that obtaining qualities such as high strength at little or no sacrifice in toughness, or where toughness can be controlled as the strength is increased would result in a remarkably unique aluminum-lithium alloy product.

It is known that the addition of lithium to aluminum alloys reduces their density and increases their elastic moduli producing significant improvements in specific stiffnesses. Furthermore, the rapid increase in solid solubility of lithium in aluminum over the temperature range of 0° to 500° C. results in an alloy system which is amenable to precipitation hardening to achieve strength levels comparable with some of the existing commercially produced aluminum alloys. However, the demonstratable advantages of lithium containing alloys have been offset by other disadvantages such as limited fracture toughness and ductility, delamination problems or poor stress corrosion cracking resistance etc.

Thus only four lithium containing alloys have achieved significant usage in the aerospace field. These are two American alloys, X2020 and 2090, a British alloy 8090 and a Russian alloy 01420.

An American alloy, X2020, having a composition of Al-4.5Cu-1.1Li-0.5Mn-0.2Cd (all figures relating to a composition now and hereinafter in wt. %) was registered in 1957. The reduction in density associated with the 1.1% lithium addition to X2020 was 3% and although the alloy developed very high strengths, it also possessed very low levels of fracture toughness, making its efficient use at high stresses inadvisable. Further ductility related problems were also discovered during forming operations. Eventually, this alloy has been formally withdrawn since 1974.

Another American alloy, 2090, having a composition of Al—2.4 to 3.0 Cu—1.9 to 2.6 Li—0.08 to 0.15 Zr, was registered at Aluminum Association in 1984. Although this alloy developed high strengths, it also possessed poor fracture toughness and poor short transverse ductility associated with delamination problems and prevented alloy 2090 from wide range commercial implementation.

A British alloy, 8090 having a composition of Al—1.0 to 1.6 Cu—0.6 to 1.3 Mg—2.2 to 2.7 Li—0.04 to 0.16 Zr, was registered at Aluminum Association in 1988. The reduction in density associated with 2.2 to 2.7 wt. Li was significant. However, its limited strength capability with poor fracture toughness and poor stress corrosion cracking resistance prevented alloy 8090 from becoming a widely accepted alloy for aerospace and aircraft applications.

A Russian alloy, 01420, containing Al—4 to 7 Mg—1.5 to 2.6 Li—0.2 to 1.0 Mn—0.05 to 0.3 Zr (either or both of Mn and Zr being present), was described in U.K. Pat. No. 1,172,736 by Fridlyander et al. The Russian alloy 01420 possesses specific moduli better than those of conventional alloys, but its specific strength levels are only comparable with the commonly used 2000 series aluminum alloys so that weight savings can only be achieved in stiffness critical applications.

It is also known that the inclusion of magnesium with lithium in an aluminum alloy may impart high strength and low density to the alloy, but these elements are not of themselves sufficient to produce high strength without other secondary elements. Secondary elements such as copper and zinc provide improved precipitation hardening response; zirconium provides grain size control, and elements such as silicon and transition metal elements provide thermal stability at intermediate temperatures up to 200° C. However, combining these elements in aluminum alloys has been difficult because of the reactive nature in liquid aluminum which encourages the formation of coarse, complex intermetallic phases during conventional casting.

Therefore, considerable effort has been directed to producing low density aluminum based alloys capable of being formed into structural components for the aircraft and aerospace industries. The alloys provided by the present invention are believed to meet this need of the art.

SUMMARY OF THE INVENTION

It is accordingly one object of the present invention to provide a low density, high strength aluminum based alloy which contains lithium and magnesium.

A further object of the invention is to provide a low density, high strength aluminum based alloy which contains critical amounts of lithium, magnesium, silver and zinc.

A still further object of the invention is to provide a method for production of such alloys and their use in aircraft and aerospace components.

Other objects and advantages of the present invention will become apparent as the description thereof proceeds.

In satisfaction of the foregoing objects and advantages, there is provided by the present invention an aluminum based alloy consisting essentially of the following formula:

$$Mg_aLi_bZn_cAg_dAl_{bal}$$

wherein a, b, c, d and bal indicate the amounts of elements present in the alloy and wherein a ranges from 0.5 to 10.0%, b ranges from 0.5 to 3.0%, c ranges from 0.1 to 5.0%, d ranges from 0.10 to 2.0%, and bal indicates that the balance of the composition is aluminum, the ranges being in weight percent based on the total alloy, with the proviso that the total amount of alloying elements may not exceed 12.0 wt. %, and with the further proviso that when a ranges from 7.0 to 10.0%, b cannot exceed 2.5% and c cannot exceed 2.0%.

The present invention also provides a method for preparation of the alloy compositions which comprises a) casting an ingot of the alloy;
b) relieving stress in the ingot;
c) homogenizing the grain structure by heating the ingot and cooling;
d) hot rolling to a final gauge;
e) soaking at elevated temperature;
f) quenching;
g) stretching to desired elongation; and
h) aging.

Also provided by the present invention is use of this alloying composition in aircraft and structural components.

DESCRIPTION OF PREFERRED EMBODIMENTS

The present invention provides a low density aluminum based alloy which contains magnesium, lithium, zinc and silver as essential components and optionally, additives for the control of grain size and to control grain growth if recrystallized. The aluminum based low density alloy of the invention consists essentially of the formula $$Mg_aLi_bZn_cAg_dAl_{bal}$$

wherein a ranges from 0.5 to 10%, b ranges from 0.5 to 3.0%, c ranges from 0.1 to 5.0%, d ranges from 0.10 to 2.0%, and bal indicates that the balance of the composition is aluminum, with the proviso that the total amount of alloying elements may not exceed 12.0 wt. % and with the further proviso that when a ranges from 7.0 to 10.0%, b cannot exceed 2.5% and c cannot exceed 2.0%.

A preferred alloy composition according to this invention is an alloy wherein a ranges from 4.0 to 6.5, b ranges from 1.5 to 2.2, c ranges from 0.3 to 1.5 and d ranges from 0.3 to 1.0% with the balance aluminum.

A preferred low lithium alloy of the present invention is a composition wherein a is 7.0–10.0, b is 1.0–1.5, c is 0.3–1.0 and d is 0.3–1.0 with the balance aluminum. A preferred high lithium alloy of the present invention is a composition wherein a is 3.0 to 5.5, b is 2.2 to 3.0, c is 0.3–1.0 and d is 0.3 to 1.0, with the balance aluminum.

A preferred low magnesium, low lithium alloy of the invention is an alloy wherein a is 2.0 to 3.0, b is 1.0 to 2.0, c is 4.0 to 6.0, d is 0.3 to 1.0 with the balance aluminum.

The most preferred composition is an alloy of the following formula:

$$Mg_aLi_bZn_cAg_dZr_eAl_{bal}$$

wherein a is 4.4, b is 1.8, c is 0.5, d is 0.3 and e is 0.14, and bal is the balance of the alloy. This alloy has a density of 0.091 lbs/in$^3$.

The alloys of the present invention may also contain additional elements to control grain size, for recrystallization during heat treatment following mechanical working, such as zirconium, manganese, chromium, hafnium, scandium, titanium etc.

Zirconium additions have been found to be an effective and economically attractive method to control grain size and prevent recrystallization. Strength and ductility improvements in zirconium containing alloys can be directly related to the unrecrystallized grain structure produced by the use of zirconium. A preferred level of zirconium addition would be 0.10 to 0.2 wt. %. Up to 1.0 wt. % of other refining elements may be added. Manganese may be added 0.1 to 1.0 wt. %. Hafnium may be added 0.1 to 0.5 wt. %. Scandium may be added 0.1 wt. % to 0.8 wt. %. Titanium may be added 0.01 to 0.2 wt. %. Chromium may be added in an amount of 0.1 wt. % to 0.5 wt. %. (These elements may be added as one element alone or added together in various combinations).

While providing the alloy product with controlled amounts of alloying elements as described hereinabove, it is preferred that the alloy be prepared according to specific method steps in order to provide the most desirable characteristics of both strength and fracture toughness. Thus, the alloy as described herein can be provided as an ingot or billet for fabrication into a suitable wrought product by casting techniques currently employed in the art for cast products, with continuous casting being preferred. It should be noted that the alloy may also be provided in billet form consolidated from fine particulate such as powdered aluminum alloy having the compositions in the ranges set forth hereinabove. The powder or particulate material can be produced by processes such as atomization, mechanical alloying and melt spinning. The ingot or billet may be preliminarily worked or shaped to provide suitable stock for subsequent working operations. Prior to the principal working operation, the alloy stock is preferably subjected to homogenization to homogenize the internal structure of the metal. Homogenization temperature may range from 650°–930° F. A preferred time period is about 20 hours or more in the homogenization temperature range. Normally, the heat up and homogenizing treatment does not have to extend for more than 40 hours; however, longer times are not normally detrimental. A time of 20 to 40 hours at the homogenization temperature has been found quite suitable. In addition to dissolving constituents to promote workability, this homogenization treatment is important in that it is believed to precipitate dispersoids which help to control final grain structure.

After the homogenizing treatment, the metal can be rolled or extruded or otherwise subjected to working operations to produce stock such as sheet, plate or extrusions or other stock suitable for shaping into the end product.

That is, after the ingot has been homogenized it may be hot worked or hot rolled. Hot rolling may be performed at a temperature in the range of 700° to 950° F. with a typical temperature being in the range of 700° to 950° F. Hot rolling can reduce the thickness of the ingot to one-fourth of its original thickness or to final gauge, depending on the capability of the rolling equipment. Cold rolling may be used to provide further gauge reduction. Hot or cold rolling can be used to produce final gauge thickness.

The rolled material in sheet form is preferably solution heat treated typically at a temperature in the range of 960° to 1040° F. for a period in the range of 0.25 to 5 hours. To further provide for the desired strength and fracture toughness necessary to the final product and to the operations in forming that product, the product should be rapidly quenched to prevent or minimize uncontrolled precipitation of strengthening phases. Thus, it is preferred in the practice of the present invention that the quenching rate be at least 100° F. per second from solution temperature to a temperature of about 200° or lower. A preferred quenching rate is at least 200° F. per second in the temperature range of 900° F. or more to 200° F. or less. After the metal has reached a temperature of about 200° F., it may then be air cooled. When the alloy of the invention is slab cast or roll cast, for example, it may be possible to omit some or all of the steps referred to hereinabove, and such is contemplated within the purview of the invention.

After solution heat treatment and quenching as noted, the improved sheet, plate or extrusion or other wrought products are artificially aged to improve strength, in which case fracture toughness can drop considerably. To minimize the loss in fracture toughness associated with improvement in strength, the solution heat treated and quenched alloy product, particularly sheet, plate or extrusion, may be stretched, preferably at room temperature.

After the alloy product of the present invention has been worked, it may be artificially aged to provide the combination of fracture toughness and strength which are so highly desired in aircraft members. This can be accomplished by subjecting the sheet or plate or shaped product to a temperature in the range of 150° to 400° F. for a sufficient period of time to further increase the yield strength. Preferably, artificial aging is accomplished by subjecting the alloy product to a temperature in the range of 275° to 375° F. for a period of at least 30 minutes. A suitable aging practice contemplates a treatment of about 8 to 24 hours at a temperature of about 340° F. Further, it will benoted that the alloy product in accordance with the present invention may be subjected to any of the typical underaging treatments well known in the art, including natural aging. Also, while reference has been made to single aging steps, multiple aging steps, such as two or three aging steps, are contemplated and stretching or its equivalent working may be used prior to or even after part of such multiple aging steps.

The Mg-Li-Ag-Zn-containing aluminum alloys of the present invention provide outstanding properties for a low density, high strength alloy. In particular, the alloy compositions of the present invention exhibit an ultimate tensile strength as high as 72 ksi with an ultimate tensile strength (UTS) which ranges from 69–72 ksi depending on conditioning, a tensile yield strength (TYS) of as high as 66 ksi and ranging from 63–66 ksi, and an elongation of up to 9%. These are outstanding results for an alloy composition of low density and makes the alloy capable of being formed into structural components for use in aircraft and aerospace applications. It has been particularly found that the combination of and critical control of the amounts of lithium, magnesium, zinc and silver alloying components enable one to obtain a low density alloy having excellent tensile strength and elongation. The density of the alloy according to the present invention is as low as 0.091 lbs/in$^3$ and ranges from 0.089 lbs/in$^3$ to 0.095 lbs/in$^3$.

In the preferred method of the invention, the alloys are formulated in molten form and then cast into an ingot. Stress is then relieved in the ingot by heating at 600° to 650° F. for 6 to 10 hours. The ingot is then homogenized at temperatures ranging from 650° F. to 1000° F. at 50° F./hr., then soaked at 900°–975° F. for 20–50 hours and air cooled. Thereafter, the alloy is converted into a usable article by conventional mechanical deformation techniques such as rolling, extrusion or the like. The alloy may be subjected to hot rolling and preferably is heated to roll at 900° F. to final gauge between 900° F. to 700° F. A heat treatment may include soaking at 1000° F. for one hour followed by a cold water quench. Since the alloy has been rolled, it is generally stretched by subjecting it to an immediate stretch of 5 to 6%. The aluminum alloy then can be further treated by aging under various conditions but preferably at 340° F. for eight hours for peak strength, or 340° F. for 16 to 24 hours for an overaged condition.

Aging is carried out to increase the strength of the material while maintaining its fracture toughness and other engineering properties at relatively high levels. Since high strength is preferred in accordance with this invention, the alloy is aged at 340° F. for 4–12 hours to achieve peak strength. At higher temperatures, less time will be needed to attain the desired strength levels than at lower aging temperatures.

When the above treatments on the alloy are carried out, the treatment will result in an Al-Li alloy having a tensile yield strength on the order of 63–66 ksi and ultimate yield strength of 69–72 ksi.

The following example is presented to illustrate the invention, but the invention is not to be considered as limited thereto. In this example and throughout the specification, parts are by weight unless otherwise indicated.

EXAMPLE

Duplicates of three separate alloys were prepared according to the following procedure. An aluminum alloy containing 4.4% magnesium, 1.8% lithium, 0.5% zinc, 0.3% silver, and 0.14% zirconium, with the balance being aluminum, was formulated. The alloy was cast as an ingot into a 30-pound permanent mold casting. The ingot was then subjected to stress relief by heating at 650° F. for eight hours. Thereafter, the ingot was homogenized by heating at 50° F. up to 650° F. to 930° F., and then soaked for 36 hours at 930° F. The ingot was then air cooled and hot rolled at 900° F. to a final gauge of 0.375 inch at the temperature of 700° F. to 900° F. The hot rolled ingot was then heat treated by soaking at 1000° F. for one hour, then subjected to a cold water quench, and then immediately stretched 5.6%. The ingot was then subjected to aging under the following conditions for three separate sets of ingots prepared according to this example:

1. 340° F./8 hours for peak strength;
2. 340° F./16 hours for overaged condition;
3. 340° F./24 hours for overaged condition.

During aging, the heat-up rate was 50° F. for all applications.

The ingots produced according to this example were then subjected to measurements of ultimate tensile strength (UTS), 0.2% offset tensile yield strength (TYS), and elongation. The results are presented in the following table were UTS is Ultimate Tensile Strength, TYS is Tensile Yield Strength and El is Elongation. The tensile tests were conducted with 0.25 inch diameter round tension specimens. The tensile elongation values were measured from one inch gauge length.

TABLE

MECHANICAL PROPERTY RESULTS (averaged values from duplicates)

| | UTS | TYS | El |
|---|---|---|---|
| At Peak Aged condition: (340° F./8 hours) | 72 ksi | 66 ksi | 9% |
| At Overaged condition: | | | |
| (340° F./16 hours) | 69.4 ksi | 64.4 ksi | 9% |
| (340° F./24 hours) | 69.8 ksi | 63.3 ksi | 9% |

It was discovered according to the present invention that the combination of components in the aluminum alloy system of this invention increases tensile yield strength and elongation substantially.

The tensile yield strength of the ingots from Example 1 were compared with a known alloy of the composition:

4.5 Mg, 1.8 Li, 0.3 Ag, 0.14 Zr, Balance Aluminum, but 0.0% Zn.

This prior art alloy, aged at 340° F. for 24 hours, exhibits an ultimate tensile strength (UTS) of 69.5 ksi but a tensile yield strength (TYS) of only 53.3 ksi, and an elongation of 7%.

The invention has been described herein with references to certain preferred embodiments. However, as obvious variations thereon will become apparent to those skilled in the art, the invention is not to be considered as limited thereto.

What is claimed is:

1. A low density aluminum based alloy consisting essentially of the formula $$Mg_aLi_bZn_cAg_dAl_{bal}$$

wherein a ranges from 0.5 to 10.0%, b ranges from 0.5 to 3.0%, c ranges from 0.1 to 5.0%, d ranges from 0.10 to 2.0%, and bal indicates that the balance of the composition is aluminum, with the proviso that the total amount of alloying elements may not exceed 12.0 wt. %, and with the further proviso that when a ranges from 7.0 to 10.0%, b cannot exceed 2.5% and c cannot exceed 2.0%.

2. An aluminum based alloy according to claim 1 which also contains zirconium in an amount of up to 1.0%.

3. An aluminum based alloy according to claim 1 which has a density of about 0.091 lbs/in.$^3$.

4. An aluminum based alloy according to claim 1 wherein a is 7.0 to 10.0%, b is 1.0 to 1.5%, c is 0.3 to 1.0% and d is 0.3 to 1.0%.

5. An aluminum based alloy according to claim 1 wherein a is 3.0 to 5.5%, b is 2.2 to 3.0%, c is 0.3 to 1.0% and d is 0.3 to 1.0%.

6. An aluminum based alloy according to claim 1 wherein a is 2.0 to 3.0%, b is 1.0 to 2.0%, c is 4.0 to 6.0%, and d is 0.3 to 1.0% with the balance aluminum.

7. A low density aluminum alloy consisting essentially of the formula $$Mg_aLi_bZn_cAg_dZr_eAl_{bal}$$

wherein a is 4.4, b is 1.8, c is 0.5, d is 0.3 and e is 0.14 and bal indicates the balance is aluminum.

8. A method for the preparation of an aluminum alloy which comprises the following steps:

a) casting an alloy ingot of the following composition:

$$Mg_a\ Li_b\ Zn_c\ Ag_d\ Al_{bal}$$

wherein a ranges from 0.5 to 10.0%, b ranges from 0.5 to 3.0%, c ranges from 0.1 to 5.0%, d ranges from 0.1 to 2.0%, and bal indicates that the balance of the alloy is aluminum, with the proviso that the total amount of alloying elements cannot exceed 12.0%, with the further proviso that when a ranges from 7.0 to 10.0%, b cannot exceed 2.5% and c cannot exceed 2.0%;

b) forming an ingot of said alloy;
c) relieving stress in said ingot by heating;
d) homogenizing by heating, soaking at an elevated temperature and cooling;
e) hot rolling to final gauge;
f) heat treating by soaking and then quenching;
g) stretching 5 to 8%; and
h) aging by heating.

9. An aerospace airframe structure produced from an aluminum alloy of claim 1.

10. An aerospace airframe structure produced by an aluminum alloy of claim 7.

11. An aerospace airframe structure produced from an aluminum alloy of claim 1.

12. An aerospace airframe structure produced from an aluminum alloy of claim 7.

* * * * *